US010470533B2

(12) United States Patent
Leiggener

(10) Patent No.: US 10,470,533 B2
(45) Date of Patent: Nov. 12, 2019

(54) TIMEPIECE OR JEWELLERY BRACELET

(71) Applicant: Montres Jaquet Droz SA, La Chaux-de-Fonds (CH)

(72) Inventor: Yann Leiggener, La Chaux-de-Fonds (CH)

(73) Assignee: Montres Jaquet Droz SA, La Chaux-de-Fonds (CH)

( * ) Notice: Subject to any disclaimer, the term of this patent is extended or adjusted under 35 U.S.C. 154(b) by 77 days.

(21) Appl. No.: 15/805,263

(22) Filed: Nov. 7, 2017

(65) Prior Publication Data

US 2018/0168293 A1 Jun. 21, 2018

(30) Foreign Application Priority Data

Dec. 20, 2016 (EP) ..... 16205514

(51) Int. Cl.
*A44C 5/10* (2006.01)
*A44C 5/00* (2006.01)

(52) U.S. Cl.
CPC ..... *A44C 5/107* (2013.01); *A44C 5/0061* (2013.01)

(58) Field of Classification Search
CPC ..... A44C 5/107; A44C 5/0061; A44C 5/08; A44C 5/105; A44C 5/027
See application file for complete search history.

(56) References Cited

U.S. PATENT DOCUMENTS 5,154,047 A 10/1992 Takagi

FOREIGN PATENT DOCUMENTS

GB 2 240 460 8/1991
JP 57-85211 U 5/1982

OTHER PUBLICATIONS

European Search Report dated May 19, 2017 in European application 16205514.9, filed on Dec. 20, 2016(with English Translation of Categories Cited Documents).

*Primary Examiner* — Jack W Lavinder
(74) *Attorney, Agent, or Firm* — Oblon, McClelland, Maier & Neustadt, L.L.P.

(57) ABSTRACT

Hinged bracelet, for a watch or piece of jewellery, comprising an alternation of H-shaped links comprising side pieces forming the side ends of this bracelet, and central links, hinged to each other by arbors formed by pins or screws, wherein at least one central link is a decorated link comprising a removable surface shell arranged to be placed on a base which includes at least a first guide member and a second guide member both substantially of revolution respectively about a first axis and a second axis parallel to and distinct from one another, and arranged to receive these arbors, and the surface shell of each decorated link is surrounded and protected on either side of its width by the side pieces of the H-shaped links.

22 Claims, 4 Drawing Sheets

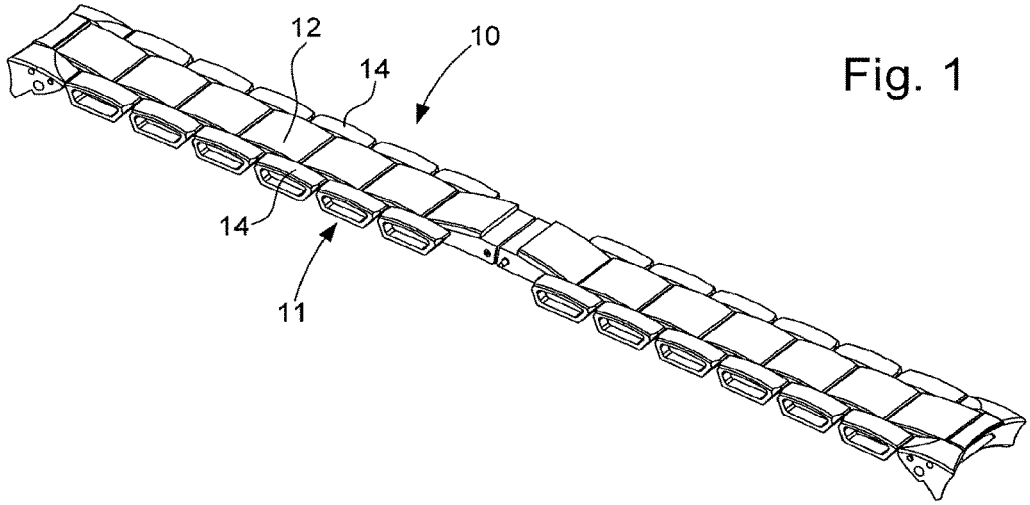
Fig. 1
Fig. 2
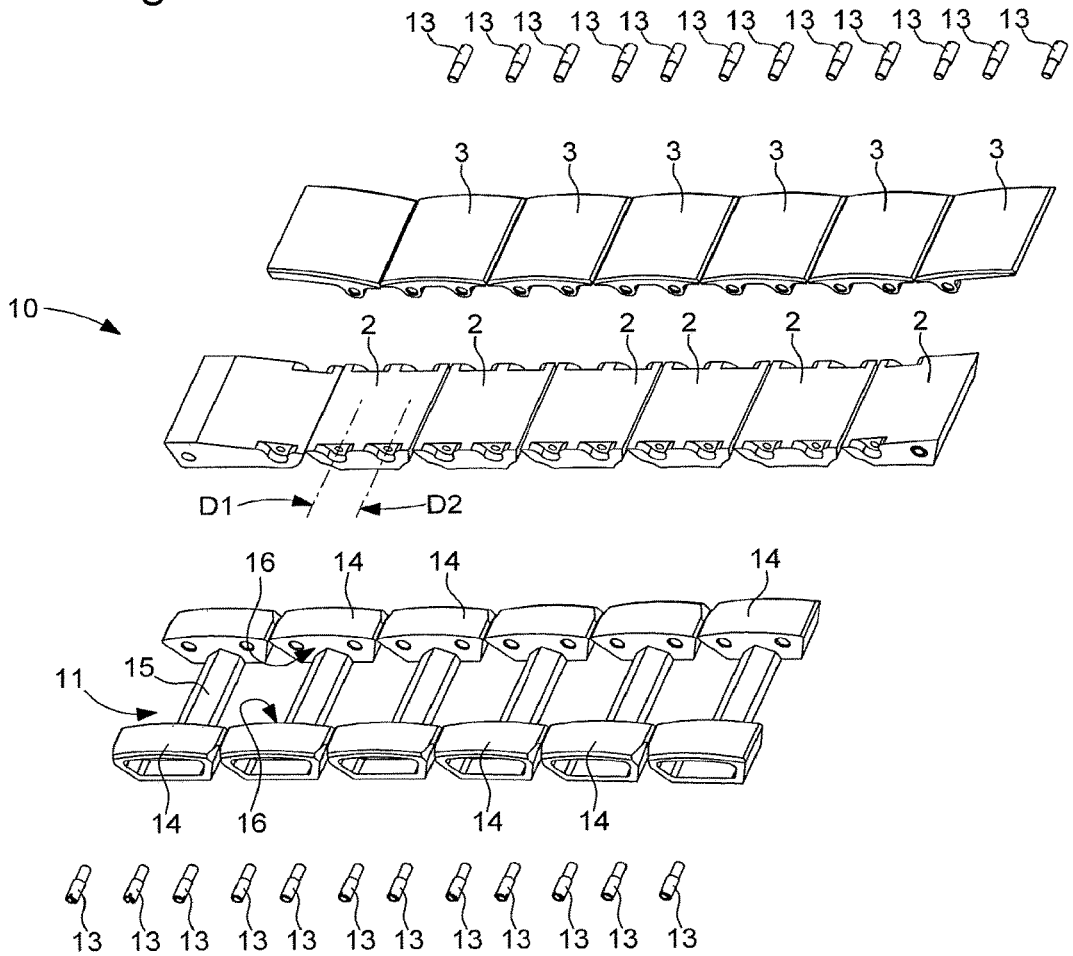

TIMEPIECE OR JEWELLERY BRACELET

This application claims priority from European Patent Application No. 16205514.9 filed on Dec. 20, 2016, the entire disclosure of which is hereby incorporated herein by reference.

FIELD OF THE INVENTION

The invention concerns a hinged timepiece or jewellery bracelet, for a watch or piece of jewellery, comprising an alternation of H-shaped links comprising side pieces forming the side ends of said bracelet, and central links, hinged to each other by arbors formed by pins or screws.

The invention also concerns a watch including a bracelet of this type.

The invention also concerns a piece of jewellery including a bracelet of this type.

The invention concerns the field of timepiece or jewellery bracelets.

BACKGROUND OF THE INVENTION

Hinged timepiece or jewellery bracelets are exposed to numerous mechanical stresses, exerted on the hinges and on the links, and consequently must comprise stiff hinges and links. This stiffness is not always compatible with the use of precious metal, rarely used for solid components and mainly in the form of electroformed components of much smaller mass, but which are more sensitive to shocks, to denting and to twisting. It is often difficult to properly ensure the protection of precious metal links inside the bracelet.

SUMMARY OF THE INVENTION

The invention proposes to produce a very stiff hinged bracelet, which is extremely easy to assemble and disassemble, and comprises links decorated either by the material chosen for the links, or by an applied or etched or set or other decoration.

To this end, the invention concerns a hinged timepiece or jewellery bracelet according to claim 1.

The invention also concerns a watch including a bracelet of this type.

The invention also concerns a piece of jewellery including a bracelet of this type.

BRIEF DESCRIPTION OF THE DRAWINGS

Other features and advantages of the invention will appear upon reading the following detailed description, with reference to the annexed drawings, in which:

FIG. 1 represents a schematic, perspective view of a bracelet according to the invention.

FIG. 2 represents a schematic, perspective, exploded view of the bracelet of FIG. 1, comprising from left to right in the Figure, assembly arbors formed by screws, H-shaped links, bases, surface shells that form decorated links with these bases, and other assembly arbors formed by screws identical to the preceding ones.

DETAILED DESCRIPTION OF PREFERRED EMBODIMENTS

Figure 3:
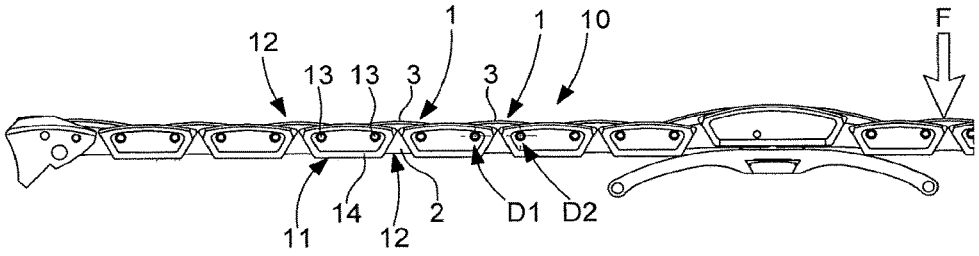
FIG. 3 represents a partial, schematic, side view of the bracelet of FIG. 1.
Figure 4:
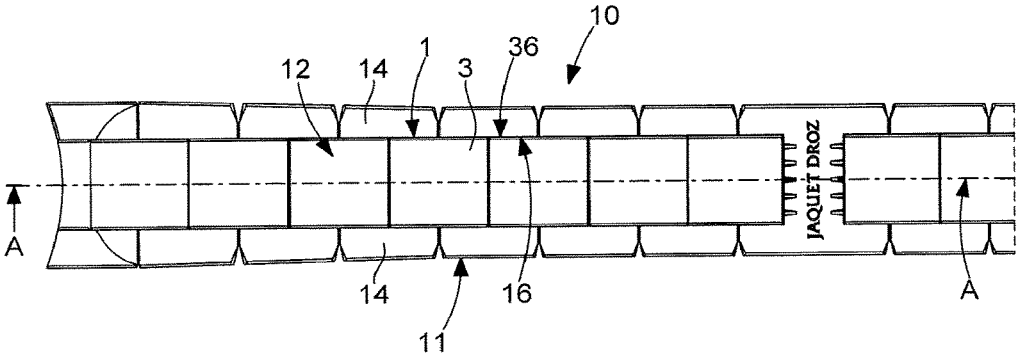
FIG. 4 represents a partial, schematic, top view in a frontal direction, of the bracelet of FIG. 1.
Figure 5:
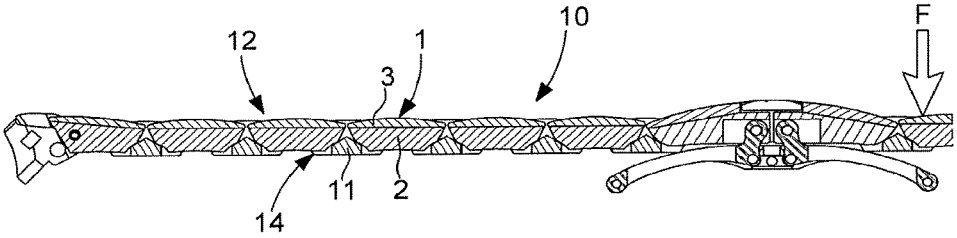
FIG. 5 represents a partial, schematic and cross-sectional view along a median plane, of the bracelet of FIG. 1.
Figure 6:
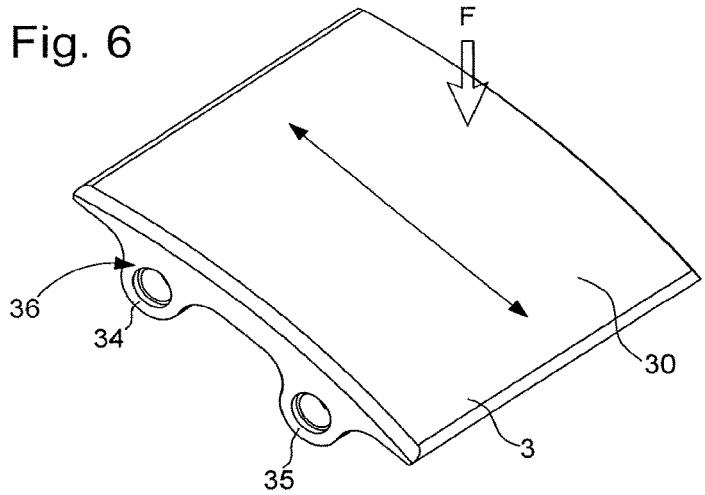
FIG. 6 represents a schematic, perspective, top view of a surface shell of one of the decorated links of this bracelet.
Figure 7:
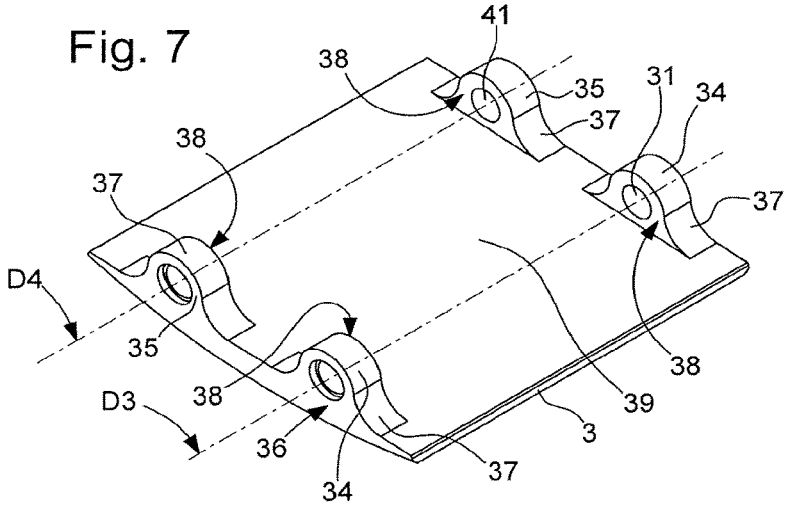
FIG. 7 represents a schematic, perspective, bottom view of the surface shell of FIG. 6.
Figure 8:
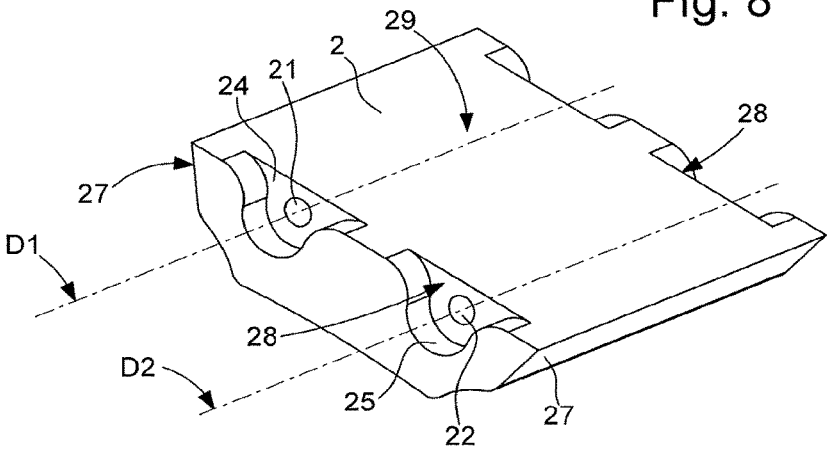
FIG. 8 represents a schematic, perspective, top view of a base of one of the decorated links of this bracelet, in a position for receiving the surface shell of FIG. 6.
Figure 9:
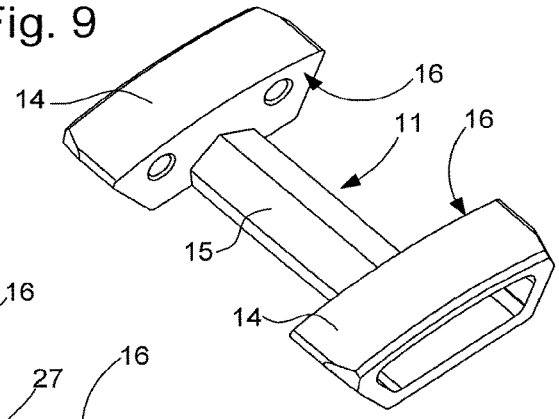
FIG. 9 represents a schematic, perspective, top view of an H-shaped link of this bracelet.
Figure 10:
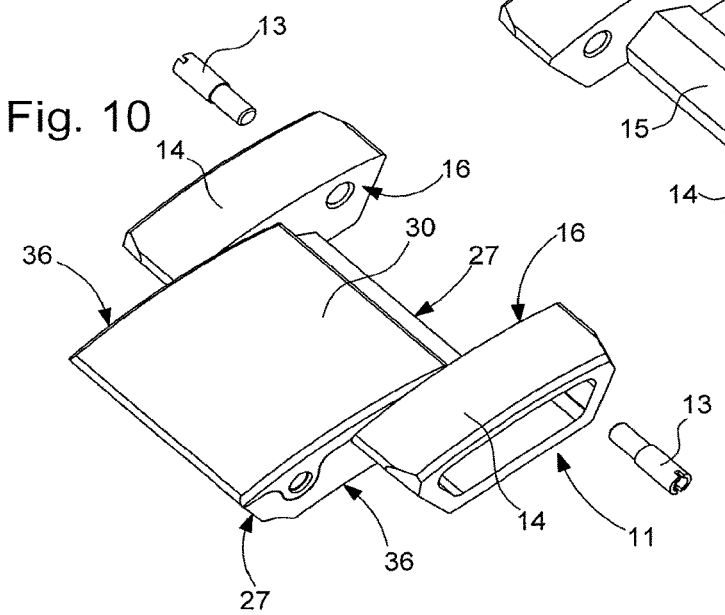
FIG. 10 represents a schematic, perspective, top view of an assembly of the base of FIG. 8 and the H-shaped link of FIG. 9.
Figure 11:
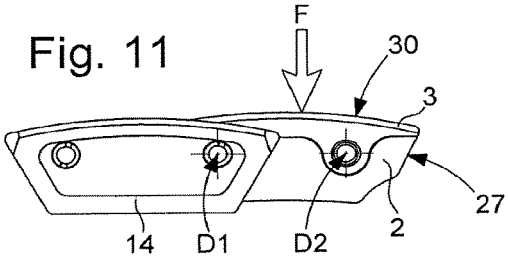
FIG. 11 represents a schematic, side view of the assembly of FIG. 10.
Figure 12:
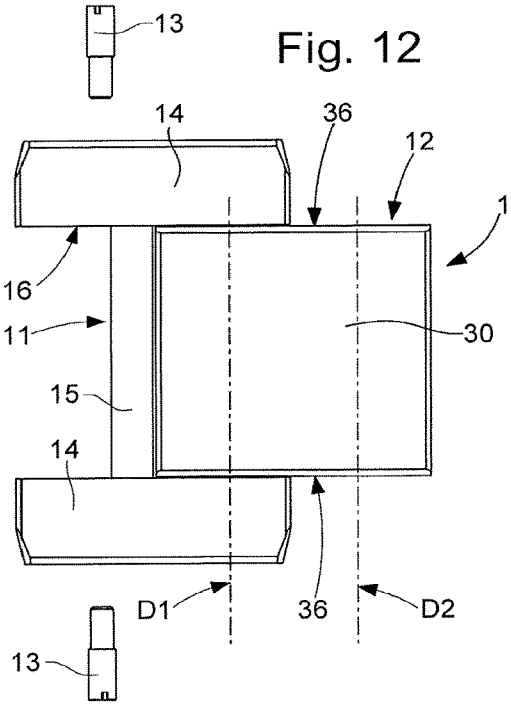
FIG. 12 represents a schematic, side view of the assembly of FIG. 11.
Figure 13:
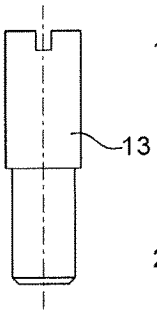
FIG. 13 represents a schematic view of an assembly screw of the bracelet of FIG. 1.
Figure 14:
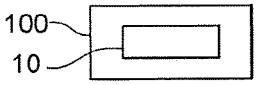
FIG. 14 is a block diagram representing a watch including such a bracelet.
Figure 15:
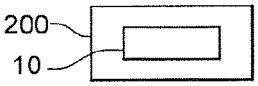
FIG. 15 is a block diagram representing a piece of jewellery including such a bracelet.

The invention concerns a hinged timepiece or jewellery bracelet 10 for a watch 100 or a piece of jewellery 200.

A "bracelet" means here, in the broad sense, any assembly of several links, some of which may be formed by clasp elements, or by fastenings to a watch or to a piece of jewellery, or by a watch or a piece of jewellery. In particular, this definition of bracelet 10 also covers what is usually referred to as a bracelet strand, i.e. a part of a complete bracelet arranged to encircle a user's wrist.

The "length" of the bracelet refers here to the longitudinal direction in which the bracelet extends when opened out by disassembling at least one hinge and placed flat. The "width" is the transverse direction perpendicular to the longitudinal direction; the pins or hinges extend in this transverse direction.

This bracelet 10 includes, along its length, an alternation of H-shaped links, referenced 11, and central links 12. H-shaped links 11 comprise side pieces 14 forming the side ends of bracelet 10. The side ends of the assembled bracelet 10 are substantially aligned parallel to the longitudinal direction and, more particularly but in a non-limiting manner, in symmetry with respect to a median plane perpendicular to the transverse direction.

H-shaped links 11 and central links 12 are hinged to each other by arbors 13 formed by pins or screws, extending in the transverse direction.

According to the invention, at least one central link 12 is a decorated link 1.

This decorated link 1 includes a removable surface shell 3, which is arranged to be placed on a base 2 comprised in decorated link 1. This base 2 includes at least a first guide member 21 and a second guide member 22, each both substantially of revolution respectively about a first axis D1 and about a second axis D2 which are parallel to and distinct from one another, and arranged to receive arbors 13. The surface shell 3 of each decorated link 1 is surrounded and protected on either side of its width by side pieces 14 of H-shaped links 11.

In the non-limiting variant illustrated by the Figures, base 2 is solid, and includes on its external portion at least one lower housing 24, 25, which is at least partially traversed by first guide member 21 or second guide member 22, and which is arranged to define a unique longitudinal assembly position for surface shell 3 with respect to base 2: this lower housing 24, 25, is arranged to cooperate in a complementary manner with an upper projecting element 34, 35 comprised in surface shell 3. Surface shell 3 includes at least a third guide member 31, substantially of revolution about a third axis D3, arranged to be aligned, in the assembly position, with first guide member 21 or second guide member 22, about first axis D1 or respectively second axis D2.

More particularly, in the variant of the Figures, base 2 includes at least a first lower housing 24, traversed by first guide member 21, arranged to cooperate with a first upper projecting element 34 of surface shell 3, and a second lower housing 25, traversed by second guide member 22, arranged to cooperate with a second upper projecting element 35 of surface shell 3.

In the variant of the Figures, surface shell 3 includes at least a fourth guide member 41 substantially of revolution about a fourth axis D4, parallel to and distinct from third axis D3, and arranged to be aligned, in the assembly position, with first axis D1 or second axis D2.

In a particular variant, in the case where a particular orientation of surface shell 3 is required for the look of the bracelet, first upper projecting element 34 has a different profile from second upper projecting element 35, to ensure a unique orientation, in the assembly position, of surface shell 3 with respect to base 2. Likewise, in a variant, lower housing 24 has a different profile from second lower housing 25, to ensure a unique orientation, in the assembly position, of surface shell 3 with respect to base 2.

Advantageously, to ensure that surface shell 3 is perfectly placed and securely held, base 2 includes a lower support surface 29 which is arranged to cooperate in a complementary manner with an upper support surface 39 comprised in surface shell 3, for three-dimensional retention in the assembly position. It is thus possible to produce a relatively thin surface shell 3, which is perfectly stiffened by base 2 and absorbs all the mechanical stresses imparted to bracelet 10. In particular, in a particular variant, surface shell 3 is made of precious metal alloy, for example an 18 carat gold alloy or similar; and, to respect the required standards of fineness, this surface shell 3 preferably has a thickness of at least 0.5 mm, and the invention is perfectly suitable for such a shell, which forms a solid precious metal component, which enhances the bracelet, which has a very attractive appearance in comparison to a simple surface treatment, which is much more robust than an electroformed hollow component, and which is quite economical in terms of the amount of precious metal used.

At least first guide member 21 or second guide member 22 is arranged to receive an arbor 13 for a hinged connection with another element of bracelet 10.

In a particular, non-illustrated variant, at least first guide member 21 or second guide member 22 is distinct from other guide members comprised in base 2 for hinged connections with other elements of a bracelet 10.

Preferably, in the assembly position, surface shell 3 at least partially surrounds base 2.

More particularly, surface shell 3 includes at least two aligned yokes 37, each including a third guide member 31 about third axis D3, and arranged, in the assembly position, to rest on either side on side surfaces 28 comprised in base 2.

More particularly, surface shell 3 includes at least two aligned yokes 37, each including a fourth guide member 41 about fourth axis D4, and arranged, in the assembly position, to rest on either side on side surfaces 28 comprised in base 2.

More particularly, in the variant of the Figures, surface shell 3 is arranged to conceal base 2 at least in a frontal direction F, and includes an appearance surface 30 intended to be seen by the user in this frontal direction F.

In a variant, surface shell 3 is made of precious material, or of precious metal alloy, or includes an added element made of precious material and including this appearance surface 30, or includes a surface layer of precious material including appearance surface 30.

In the variant of the Figures, base 2 includes peripheral abutment surfaces 27 arranged alone to withstand contact with other elements of a bracelet 10, and to keep them at a distance from surface shell 3.

In a particular variant, third guide member 31 traverses the entire width of surface shell 3.

In a particular, non-illustrated variant, first guide member 21 and said second guide member 22 traverse the entire width of base 2.

In a particular variant illustrated by the Figures, at least first guide member 21 or second guide member 22 is a blind guide member that does not traverse the entire width of base 2.

In a particular variant illustrated by the Figures, at least first guide member 21 or second guide member 22 includes an internal thread arranged to cooperate with an external thread of an assembly screw forming an arbor 13.

In a particular variant, the side pieces 14 of an H-shaped link 11 each comprise at least one internal thread arranged to cooperate with an external thread of an assembly screw forming an arbor 13, which then includes a smooth shoulder pivoting in a bore of a base 2.

In a particular variant illustrated by the Figures, the side pieces 14 of an H-shaped link 11 each include at least one bore arranged to allow the passage of an assembly screw forming an arbor 13, screwed onto a base 2, and whose screw head rests on side piece 14.

In a particular variant illustrated by the Figures, surface shell 3 is solid and has a U-shaped cross-section, and comprises a central portion which includes, on a side facing base 2, an upper support surface 39 arranged, in the assembly position, to cooperate in abutment with a lower support surface 29 comprised in base 2, and on the opposite side an appearance surface 30 intended to be seen by the user in a frontal direction F, this central portion being bordered by two discontinuous wings each including a third guide member 31 about third axis D3, and arranged, in the assembly position, to rest on either side on side surfaces 28 comprised in base 2.

Naturally, the invention is also applicable to special links where surface shell 3 includes a single guide member, and a single yoke on each side.

The number of components of bracelet 10 is reduced, since each arbor 13 (a screw in the preferred variant of the Figures) ensures both the connection and the hinge between an H-shaped link 11 and a base 2, and holds a surface shell 3 on said base 2. Bracelet 10 does not require an elastic pin, which is an advantage, since this type of screw connection is much stiffer, and does not need to be changed in an after-sales operation. It is thus possible to modify customization at any time during the life of the bracelet.

In the variant illustrated by the Figures, excluding the end and clasp interfaces, bracelet 10 comprises only four different components.

The choice of material for each of the surface shells 3 comprised in a bracelet 10 determines its appearance. Bracelet 10 may be two-tone, for example if H-shaped links 11 are made of stainless steel, or of titanium, or of ceramic, and if surface shells 3 are made of another material, particularly of a precious metal alloy. Bracelet 10 may easily be multicoloured, with surface shells 3 made of different alloys.

Naturally, each surface shell 3 may have a surface treatment, particularly a dye, and/or an etch, and/or at least one precious set stone, or other. It is easy to customize such a bracelet 10, and in particular during the life of the object, its user can simply choose to change these surface shells 3 in order to completely alter the appearance of bracelet 10.

The invention also concerns a watch 100 including such a bracelet 10. The invention also concerns a piece of jewellery 200 including such a bracelet 10.

What is claimed is:

1. A hinged timepiece or jewelry bracelet, for a watch or piece of jewelry, comprising an alternation of H-shaped links comprising side pieces forming side ends of said bracelet, and central links, hinged to each other by arbors formed by pins or screws, wherein at least one said central link is a decorated link comprising a removable surface shell arranged to be placed on a base which includes at least a first guide member and a second guide member both cylindrical about a first axis and a second axis respectively, the first and second axes being parallel to and distinct from one another, the first and second guide members respectively arranged to receive said arbors, said surface shell of each said decorated link being surrounded and protected on either side of a width of the respective surface shell by said side pieces of said H-shaped links, and said arbors hold said surface shell on said base.

2. The bracelet according to claim 1, wherein said base includes a lower support surface arranged to cooperate in a complementary manner with an upper support surface of said surface shell such that said surface shell is engaged in three-dimensional retention in said assembly position.

3. The bracelet according to claim 1, wherein at least said first guide member or said second guide member is arranged to receive an arbor for a hinged connection with another element of said bracelet.

4. The bracelet according to claim 1, wherein at least one of said first guide member or said second guide member is distinct from a third guide member of said base, the third guide member being configured to form a hinged connection with other elements of a said bracelet.

5. The bracelet according to claim 1, wherein, in said assembly position, said surface shell at least partially surrounds said base.

6. The bracelet according to claim 1, wherein said surface shell is arranged to conceal said base in at least a frontal direction, and said surface shell includes an appearance surface intended to be seen by the user in said frontal direction.

7. The bracelet according to claim 6, wherein said surface shell is made of precious material, or includes an added element made of precious material, and includes said appearance surface, or includes a surface layer of precious material, said surface layer including said appearance surface.

8. The bracelet according to claim 1, wherein said base includes peripheral abutment surfaces arranged alone to withstand contact with other elements of a said bracelet when said bracelet is in a cylindrical shape, and to keep said elements at distance from said surface shell.

9. The bracelet according to claim 1, wherein said first guide member and said second guide member traverse an entire width of said base.

10. The bracelet according to claim 1, wherein at least said first guide member or said second guide member is a blind guide member that does not traverse an entire width of said base.

11. The bracelet according to claim 1, wherein at least said first guide member or said second guide member includes an internal thread arranged to cooperate with an external thread of an assembly screw forming at least one of said arbors.

12. The bracelet according to claim 1, wherein each of said arbors is an assembly screw that includes a screw head, said side pieces of a said H-shaped link each include at least one bore arranged to allow the passage of the assembly screw when the assembly screw is screwed onto a said base, and the bore is arranged to allow said screw head to rest on said side piece.

13. The bracelet according to claim 1, wherein said surface shell is solid and has a U-shaped cross-section- and said surface shell includes a central portion, the central portion includes, on a side facing said base, an upper support surface that is arranged, in said assembly position, to cooperate in abutment with a lower support surface of said base, and the central portion includes, on a side opposite to said side facing said base, an appearance surface intended to be seen by the user in a frontal direction, said central portion being bordered by two discontinuous wings each comprising a said third guide member which includes said third axis, and said wings are arranged, in said assembly position, to rest on either side on side surfaces comprised in said base.

14. A watch including a bracelet according to claim 1.

15. A piece of jewelry including a bracelet according to claim 1.

16. A hinged timepiece or jewelry bracelet, for a watch or piece of jewelry, comprising an alternation of H-shaped links comprising side pieces forming side ends of said bracelet, and central links, hinged to each other by arbors formed by pins or screws, wherein at least one said central link is a decorated link comprising a removable surface shell arranged to be placed on a base which includes at least a first guide member and a second guide member both centered about a first axis and a second axis, respectively, the first and second axes being parallel to and distinct from one another, the first and second guide members respectively arranged to receive said arbors, said surface shell of each said decorated link being surrounded and protected on either side of a width of the respective surface shell by said side pieces of said H-shaped links, and further wherein said base is solid, and includes, on an external portion of said base, at least one lower housing, the at least one lower housing at least partially traversed by said first guide member or said second guide member, the at least one lower housing arranged to define a unique longitudinal assembly position of said surface shell with respect to said base, and arranged to cooperate in a complementary manner with an upper projecting element comprised in said surface shell, and wherein said surface shell includes at least a third guide member that is cylindrical about a third axis and that is arranged to be aligned, in said assembly position, with said first guide member or second guide member, about said first axis or said second axis, respectively.

17. The bracelet according to claim 16, wherein said base includes at least a first said lower housing, traversed by said first guide member and arranged to cooperate with a first said upper projecting element of said surface shell, and a second said lower housing, traversed by said second guide member and arranged to cooperate with a second said upper projecting element of said surface shell.

18. The bracelet according to claim 17, wherein said surface shell includes at least two aligned yokes, each including a third guide member aligned about a third axis, and the two aligned yokes are arranged, in said assembly position, to rest on either side on side surfaces of said base.

19. The bracelet according to claim 17, Wherein said surface shell includes at least a fourth guide member that includes a fourth axis, parallel to and distinct from said third axis, and said fourth axis is arranged to be aligned with said first axis or said second axis in said assembly position.

20. The bracelet according to claim 17, wherein said first upper projecting element has a different profile from said second upper projecting element, to ensure a unique orientation, in said assembly position, of said surface shell with respect to said base.

21. The bracelet according to claim 19, wherein said surface shell includes at least two aligned yokes, each including said fourth guide member, and arranged, in said assembly position, to rest on either side on side surfaces comprised in said base.

22. The bracelet according to claim 16, wherein said third guide member traverses an entire width of said surface shell.

* * * * *